US005943832A

United States Patent [19]

Russell

[11] Patent Number: 5,943,832

[45] Date of Patent: Aug. 31, 1999

[54] FLOOD OR STORM RESISTANT BARRIERS FOR DOORWAYS OR WINDOW OPENING

[76] Inventor: James E. Russell, 78 Fano Dr., Hamilton, Ontario, Canada, L8W 3T9

[21] Appl. No.: 09/052,958

[22] PCT Filed: Oct. 2, 1996

[86] PCT No.: PCT/CA96/00658

§ 371 Date: May 18, 1998

§ 102(e) Date: May 18, 1998

[87] PCT Pub. No.: WO97/13052

PCT Pub. Date: Apr. 10, 1997

[51] Int. Cl.[6] ..... E06B 9/06

[52] U.S. Cl. ..... 52/202; 49/55; 49/61; 52/645; 52/656.7

[58] Field of Search ..... 49/61, 62, 463, 49/465, 466, 55, 57; 52/202, 208, 645, 656.7

[56] References Cited

U.S. PATENT DOCUMENTS 935,673 10/1909 Miller ..... 49/55
2,518,969 8/1950 Woodard ..... 52/202
2,755,525 7/1956 Minot, Jr. ..... 49/55
5,531,258 7/1996 Poulson et al. ..... 49/465
5,673,883 10/1997 Figueroa, Jr. ..... 49/61

FOREIGN PATENT DOCUMENTS 2114197 8/1983 United Kingdom ..... 49/55

*Primary Examiner*—Michael Safavi
*Attorney, Agent, or Firm*—Rogers & Scott

[57] ABSTRACT

A flood or storm resistant barrier for a doorway or window opening. The barrier formed of a frame having two parts with one part in telescopic engagement with the other frame part. A manually operable jack in the form of four links pivotally connected to form a parallelogram linkage is inserted between the two frame parts. The jack being operable to move the frame parts relative to one another so as to vary the external dimension of the frame and thereby enable the frame to be secured in a doorway or window opening by expansion of the frame into engagement with opposed surfaces of the doorway or window opening. A waterproof barrier member is carried by the frame for blocking at least a portion of the doorway or window opening.

4 Claims, 3 Drawing Sheets

FLOOD OR STORM RESISTANT BARRIERS FOR DOORWAYS OR WINDOW OPENING

TECHNICAL VIEW

This invention relates to flood or storm resistant barriers for doorways or window openings.

BACKGROUND ART

There are various situations where such barriers are required. For example, a flood resistant barrier may be required for an external doorway of a house or other building to keep out flood water, or for an internal doorway in a building to keep water which has accumulated on the floor in one room from passing to another room. A situation of the latter may occur in a building such as an art gallery or archive storage building where a water pipe has burst or a water sprinkler system has malfunctioned. Also, a fire may have occurred in one room and have been extinguished by a water sprinkler system or other fire extinguishing water supply. A storm resistant barrier may be required for boarding up a window when severe weather or possibly rioting or looting is expected.

Although many different kinds of barriers have been proposed for such purposes in the past, there is still a need for an improved barrier of this kind.

It is therefore an object of the invention to provide an improved flood or storm resistant barrier for doorways or window openings.

DISCLOSURE OF INVENTION

According to the invention, a flood or storm resistant barrier for a doorway or window opening comprises a frame having two parts, one of the frame parts having portions in telescopic engagement with the other frame part, and a manually operable jack mounted between the two frame parts and operable to move the two frame parts relative to one another to vary an external dimension of the frame and thereby enable the frame to be secured in a doorway or window opening by expansion of the frame into engagement with opposed surfaces of the doorway or window opening. A waterproof/stormproof barrier member is carried by at least one of the frame parts for blocking at least a portion of a doorway or a window opening when the frame is secured therein.

The manually operable jack may comprise four links pivotally connected to form a parallelogram linkage, one pair of opposed pivotal connections being mounted on respective frame parts, and the other pair of opposed pivotal connections being secured to holders through which a manually rotatable adjustment rod passes to enable the configuration of the linkage and hence the relative positions of the frame parts to be adjusted.

The barrier member may comprise a bag-like member containing the frame. Resilient sealing material may be provided between the frame and the bag-like member around at least the lower portion of the frame to ensure a sealing fit between the frame and the corresponding portions of a doorway. Alternatively, the barrier member may comprise a board-like member carried by one of the frame portions and extending beyond the periphery of the frame so as to cover a window opening when the frame is installed therein.

DESCRIPTION OF DRAWINGS

Embodiments of the invention will now be described, by way of example, with reference to the accompanying drawings, of which.

BEST MODE FOR CARRYING OUT THE INVENTION

Figure 2:
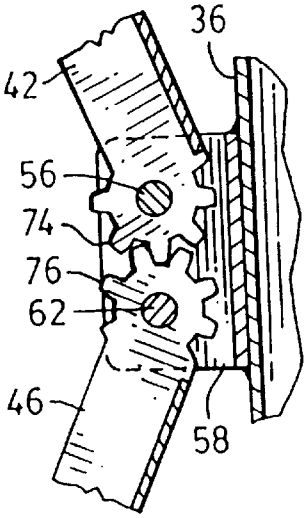
FIG. 2 is a sectional view taken along the line 2—2 of FIG. 1 and showing a detail of the jack.
Figure 1:
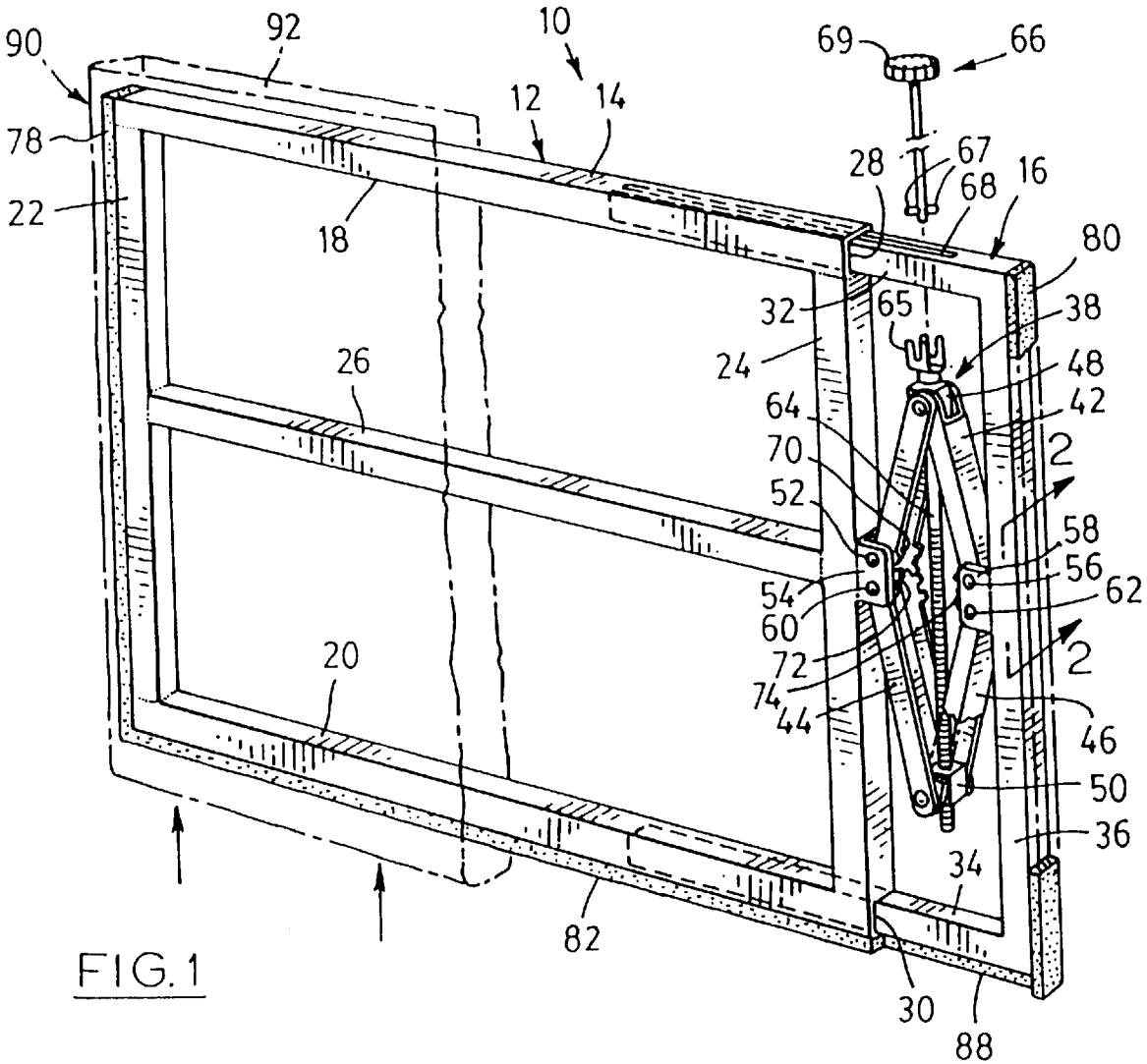
FIG. 1 is a perspective view of a flood resistant barrier in accordance with one embodiment of the invention, with the barrier member being shown in dotted outline and partly broken away to show the frame in a clearer manner.
Figure 3:
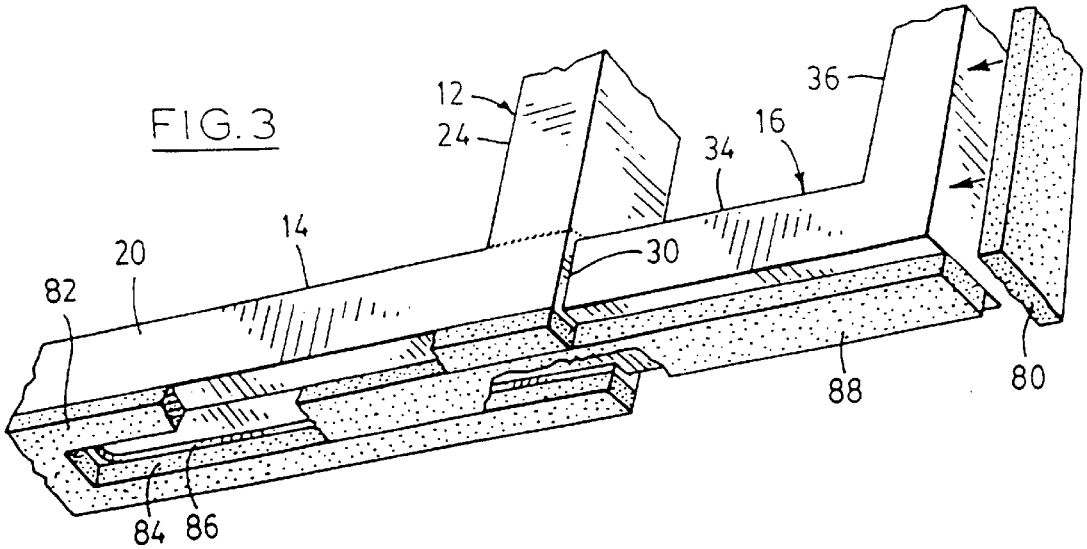
FIG. 3 is a detailed view of a lower part of the frame taken in the direction of the arrow 3 in FIG. 1 and showing the sealing arrangement thereon.

Referring to the drawings, FIGS. 1 to 4 show a flood resistant barrier 10 in accordance with one embodiment of the invention which has a rectangular frame 12 with two parts 14, 16. The first frame part 14 is of square section tubular metal with a top member 18, bottom member 20, side members 22, 24 and horizontal middle member 26, the various member being welded together. The ends 28, 30 of the top and bottom members 18, 20 at one end of the first frame part 14 are open. The second frame part 16 is of tubular metal with a slightly smaller square section than the first frame part 14, and has a top member 32, bottom member 34 and side member 36. The top and bottom members 32, 34 of the second frame part 16 extend into the top and bottom members 18, 20 of the first frame part 14 through the open ends 28, 30 so as to be telescopically slidably mounted therein.

A manually operable jack 38 is mounted between the end member 24 of the first frame part 14 and the end member 36 of the second frame part 16. The jack 38 comprises four links 40, 42, 44, 46 of channel section pivotally connected to form a parallelogram linkage. The upper ends of links 40, 42 are connected to a pivot pin 48, and the lower ends of links 44, 46 are connected to pivot pin 50. The lower end of link 40 is pivotally connected by a pivot pin 52 to a bracket 54 welded to frame end member 24, and the lower end of link 42 is pivotally connected by a pin 56, to a bracket 58 welded to frame end member 36. The upper end of link 44 is connected by a pivot pin 60 to bracket 54, and the upper end of link 46 is connected by pivot pin 62 to bracket 58. The lower end of link 40 is provided with gear teeth 70 which mesh with gear teeth 72 on the upper end of link 44. Similarly, the lower end of link 44 is provided with gear teeth 74 which mesh with gear teeth 76 on the upper end of link 46.

An adjusting rod 64 extends downwardly through an aperture in pivot pin 48 and an aperture in pivot pin 50. The lower end portion of adjusting rod 62 is screw-threaded as also is the aperture in pivot pin 50. The upper end of adjustment rod 62 has a slotted connector 65 into which pins 67 on the lower end of a manually rotatable adjuster 66 can be fitted after passing through a slot 68 in the top frame member 32. The upper end of adjuster 66 is provided with a circular hand grip 69.

The length of the frame 10 can be varied by inserting the adjuster 66 through the slot 68 so that the pins 67 engage in the slotted connector 65, and then rotating the adjuster 66 to cause the jack 38 to lengthen or shorten and similarly cause the frame 10 to lengthen or shorten by telescopic movement of the second frame part 16 relative to the first frame part 14.

The outer surfaces of the side frame members 22, 36 have a sealing strip 78, 80 of foam material secured thereto in any appropriate manner, and the bottom surface of the bottom member 20 has a sealing strip 82 of foam material secured thereto. Near the open end 30 of bottom member 20, the sealing strip 82 is cut away to form a slot 84, and the bottom part of bottom member 20 is similarly cut away to form a slot 86. A sealing strip 88 of foam material is secured to the bottom of bottom member 34 and can slide in the slots 84, 86. During telescopic movement of the second frame part 16 relative to the first frame part 14, sealing strip 88 slides in slots 84, 86.

The frame 12 is housed in a waterproof barrier member 90 of plastic sheet material in the form of a bag with an open top 92, which may of course be closed in an appropriate manner after insertion of the frame 12 if desired. The barrier member 90 has a size which fits the frame 12, except that it has a length corresponding to the maximum length of the frame 12.

INDUSTRIAL APPLICABILITY

Figure 4:
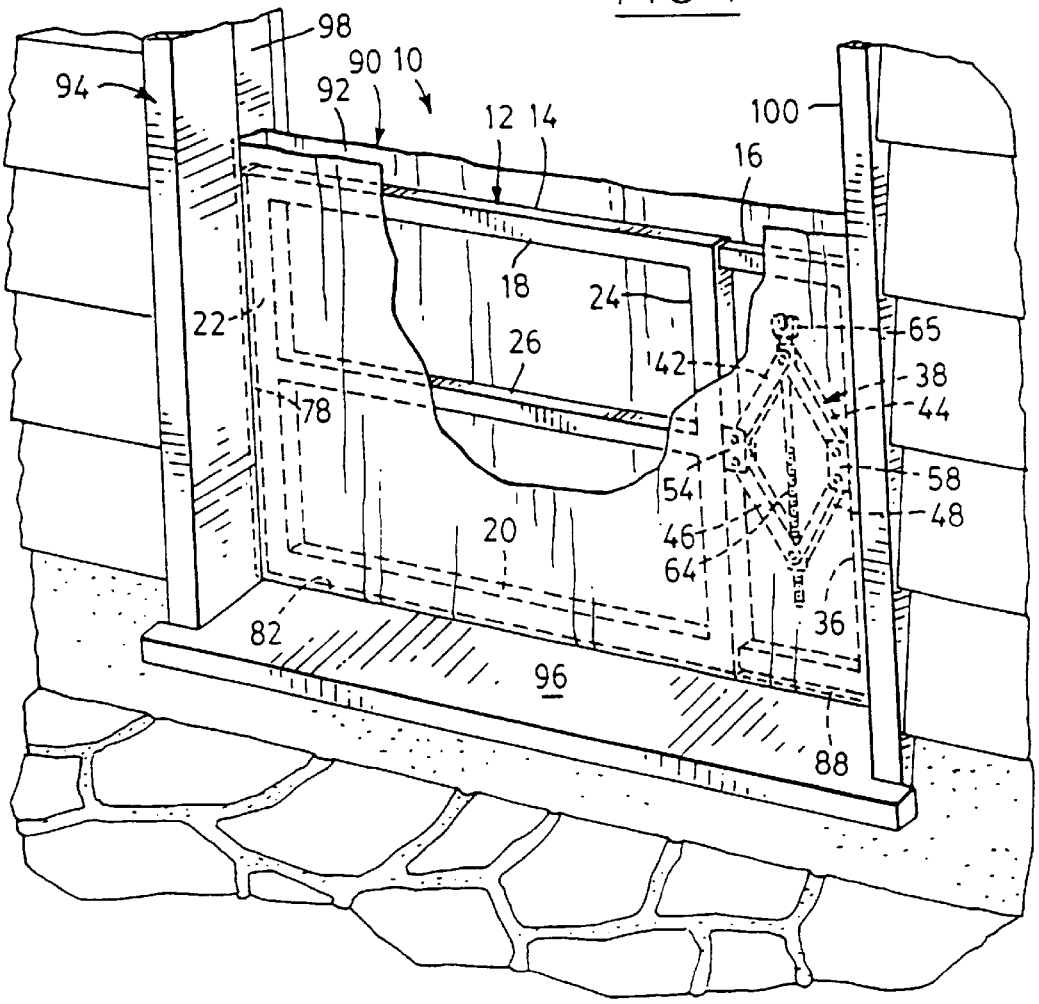
FIG. 4 is a perspective view of the flood resistant member of FIG. 1 installed in the doorway, the barrier member again being partially broken away to show the frame in a clearer manner.

The flood barrier 10 can be used for example in a doorway 94, see FIG. 4, with a width within the range of variable length of the frame 12. The frame 12 is placed on the bottom 96 of the doorway 94, and its length adjusted in the manner previously described to cause the end members 22, 36 of the respective frame parts 14, 16 to firmly engage the opposite sides 98, 100 of the doorway 94, with sealing strips 78, 80 and side portions of the barrier member 90 therebetween, thereby providing a seal between the ends of the barrier member 10 and the sides 98, 100 of the doorway 94.

The weight of the frame 12 will ensure that the sealing strips 82, 88 on the bottom portion of the frame 12 provide a seal between the bottom of the barrier member 10 and the bottom 96 of the doorway 94.

It can clearly be seen from FIG. 4 that the barrier member 10 provides an efficient flood water barrier up to the height of the barrier member 10. The doorway 94 can be an external doorway as shown to protect against floods caused by weather-related flooding, or may be an internal doorway to protect against water, for example from a burst pipe or other unwanted water in a building.

Figure 5:
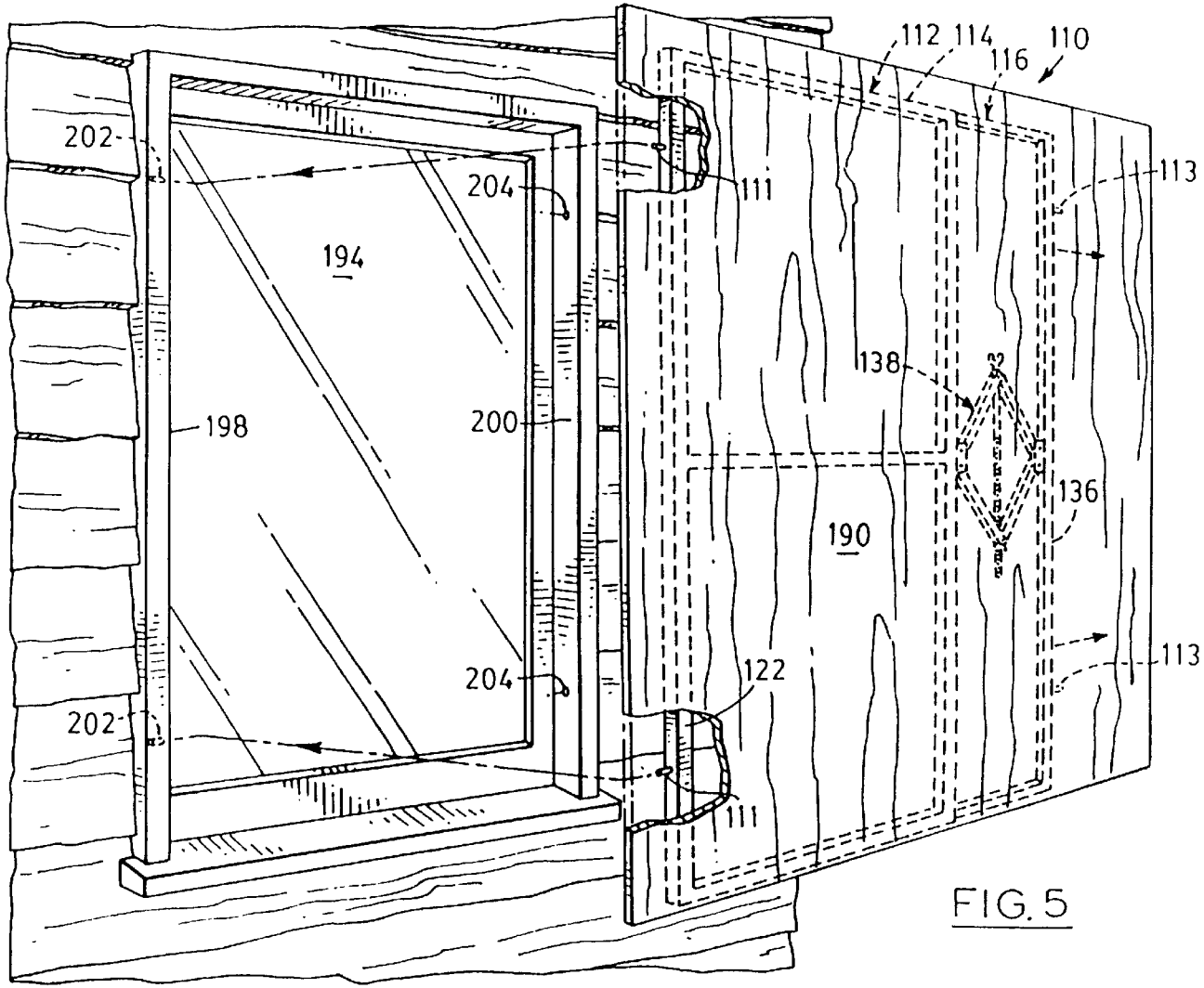
FIG. 5 is a perspective view of a storm resistant barrier in accordance with a second embodiment of the invention positioned for installation in a window frame.

In the embodiment shown in FIG. 5, a storm resistant barrier 110 has a frame 112 which is substantially the same as the frame 12 of the previous embodiment, and a manually operable jack 138 which is substantially the same as the jack 38. Instead of a barrier member in the form of a bag however, a barrier member 190 is in the form of a rectangular board which is secured in any suitable manner to the first frame part 114 only, the barrier board 190 being somewhat larger in length and height than the frame 112. The end members 122, 138 of the frame 112 are provided with projecting pegs 111, 113.

The storm barrier 110 can be used for example to protect a window 194 with a width in the range of length adjustability of the frame 112. The frame 112 is positioned between the sides 190, 200 of the window 194, and the frame 112 is lengthened by use of the manually operable adjuster 66 (not shown in FIG. 4) to secure the frame 112 in the window frame. Pegs 111, 113 fit into pre-drilled holes 202, 204 in the window frame sides 198, 200. The barrier board 190 extends over the window 194 and beyond the top, bottom and sides of the window frame to protect the window from storm damage. The barrier 110 could also be used for protection against rioting or looting.

Other embodiments of the invention will be readily apparent to a person skilled in the art. For example, the frame may be made of synthetic plastic material instead of metal.

I claim:

1. A flood or storm resistant barrier for a doorway or window opening including:

a frame having two parts, one of the frame parts having portions in telescopic engagement with the other frame part, manually operable jack mounted between the two frame parts and operable to move the two frame parts relative to one another to vary an external dimension of the frame and thereby enable the frame to be secured in a doorway or window opening by expansion of the frame into engagement with opposed surfaces of the doorway or window opening, said manually operable jack having four links pivotally connected to form a parallelogram linkage, one pair of opposed pivotal connections being mounted on respective frame parts, and the other pair of opposed pivotal connections being secured to holders through which a manually rotatable adjustment rod passes to enable the configuration of the linkage and hence the relative positions of the frame parts to be adjusted, a waterproof barrier member carried by at least one of the frame parts for blocking at least a portion of a doorway or a window opening when the frame is secured therein.

2. A flood or storm resistant barrier according to claim 1 in which the barrier member comprises a bag-like member containing the frame.

3. A flood or storm resistant barrier according to claim 2 in which resilient sealing material is provided between the frame and the bag-like member around at least a lower portion of the frame to ensure a sealing fit between the frame and corresponding portions of a doorway.

4. A flood or storm resistant barrier according to claim 1 in which the barrier member comprises a board-like member carried by one of the parts and extending beyond the periphery of the frame so as to cover a window opening when the frame is installed therein.

* * * * *